US006257581B1

(12) United States Patent
New

(10) Patent No.: US 6,257,581 B1
(45) Date of Patent: Jul. 10, 2001

(54) METHOD OF PLAYING A CARD GAME

(76) Inventor: Larry D. New, 72 Cedar St., Summerville, GA (US) 30747

( * ) Notice: Subject to any disclaimer, the term of this patent is extended or adjusted under 35 U.S.C. 154(b) by 0 days.

(21) Appl. No.: 09/570,348

(22) Filed: May 12, 2000

(51) Int. Cl.[7] ..... A63F 1/00
(52) U.S. Cl. ..... 273/292; 273/303; 273/307
(58) Field of Search ..... 273/292, 299, 273/300, 301, 302, 303, 304, 305, 306, 307, 308

(56) References Cited

U.S. PATENT DOCUMENTS

| | | |
|---|---|---|
| 1,557,694 | 10/1925 | Hino et al. . |
| 5,374,067 | 12/1994 | Jones . |
| 5,380,012 | 1/1995 | Jones et al. . |
| 5,601,488 | 2/1997 | Kadlic . |
| 5,711,526 | 1/1998 | Van Hollebeke . |
| 5,810,361 | 9/1998 | Kadlic . |
| 5,853,325 | 12/1998 | Kadlic . |
| 5,863,042 | 1/1999 | Lo . |

OTHER PUBLICATIONS

Diagram Group, "The Way To Play", 1975, pp. 110 and 111.*
Gibson, "Hoyle's Modern Encyclopedia of Card Games", 1974, pp. 43, 46, 49.*

* cited by examiner

*Primary Examiner*—Jeanette Chapman
*Assistant Examiner*—Zelalem Eshete
(74) *Attorney, Agent, or Firm*—Porter, Wright, Morris & Arthur

(57) ABSTRACT

A method of playing a card game is provided that includes providing a deck of playing cards and dealing a hand of cards to each player on each team. Each player is allowed to draw a card from a face-up discard pile or from a face-down set of cards, lay down a predetermined set of cards, and discard a card from the player's hand. Each round is ended when a player has no cards remaining in his hand, at which time each team's score for the round is determined. Each set of cards required to be laid down to end the game is predetermined, with each team having differing sets of cards required to be laid down to end the game. The game is ended when a team has laid down each predetermined set of cards required to be laid down to end the game, at which time the winning team is determined by the team with the highest score. Each team's score is determined by granting a pre-selected point value to a team's score for each set of cards laid down by each player on that team during each round, subtracting a pre-selected point value from each team's score for certain pre-selected cards remaining in each player's hand on that team at the end of each round, and subtracting a pre-selected point value from each team's score for certain pre-selected cards laid down by each player on another team during each round.

17 Claims, 2 Drawing Sheets

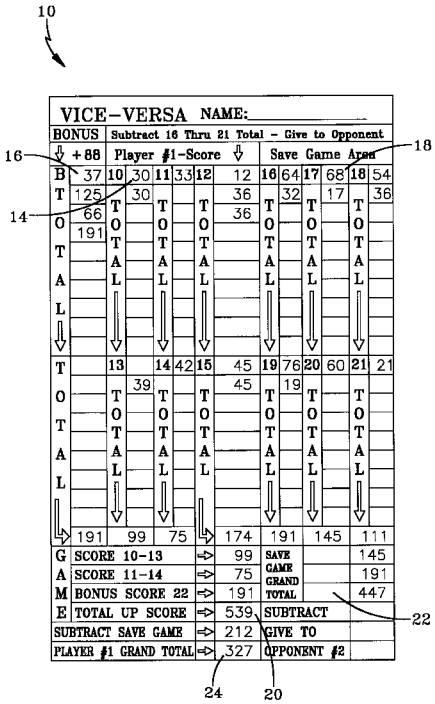

10

| VICE–VERSA NAME:_____ | | | | | | | | | | | | |
|---|---|---|---|---|---|---|---|---|---|---|---|---|
| BONUS | Subtract 16 Thru 21 Total – Give to Opponent | | | | | | | | | | | |
| ⇩ +88 | Player #1–Score ⇩ | | | | | | Save Game Area | | | | | |
| B 37 | 10 | 30 | 11 | 33 | 12 | 12 | 16 | 64 | 17 | 68 | 18 | 54 |
| T 125 | | 30 | | | | 36 | | 32 | | 17 | | 36 |
| 66 | T | | T | | T | 36 | T | | T | | T | |
| O 191 | O | | O | | O | | O | | O | | O | |
| T | T | | T | | T | | T | | T | | T | |
| A | A | | A | | A | | A | | A | | A | |
| L ⇩ | L ⇩ | | L ⇩ | | L ⇩ | | L ⇩ | | L ⇩ | | L ⇩ | |
| T | 13 | | 14 | 42 | 15 | 45 | 19 | 76 | 20 | 60 | 21 | 21 |
| | | 39 | | | | 45 | | 19 | | | | |
| O | T | | T | | T | | T | | T | | T | |
| T | O | | O | | O | | O | | O | | O | |
| A | T | | T | | T | | T | | T | | T | |
| L | A | | A | | A | | A | | A | | A | |
| | L ⇩ | | L ⇩ | | L ⇩ | | L ⇩ | | L ⇩ | | L ⇩ | |
| ⇨ 191 | 99 | | 75 | | ⇨ 174 | | 191 | | 145 | | 111 | |

| | | | | | |
|---|---|---|---|---|---|
| G | SCORE 10–13 | ⇨ | 99 | SAVE GAME GRAND TOTAL | 145 |
| A | SCORE 11–14 | ⇨ | 75 | | 191 |
| M | BONUS SCORE 22 | ⇨ | 191 | | 447 |
| E | TOTAL UP SCORE | ⇨ | 539 | SUBTRACT | |
| SUBTRACT SAVE GAME | | ⇨ | 212 | GIVE TO | |
| PLAYER #1 GRAND TOTAL | | ⇨ | 327 | OPPONENT #2 | |

16 14 18 22 24 20

FIG–1

12

| VICE–VERSA NAME:_____ | | | | | | | | | | | | | |
|---|---|---|---|---|---|---|---|---|---|---|---|---|---|
| BONUS | Subtract 10 Thru 15 Total – Give to Opponent | | | | | | | | | | | | |
| ⇩ +88 | Player #2–Score ⇩ | | | | | | | Save Game Area | | | | | |
| 16 | | | | | | | | | | | | | 18 |
| B | –37 | 16 | 16 | 17 | 68 | 18 | 54 | 10 | 10 | 11 | 33 | 12 | 36 |
| T | 51 | T | 64 | T | | T | | T | 10 | T | | T | |
| O | +88 | O | | O | | O | | O | | O | | O | |
| T | 139 | T | | T | | T | | T | | T | | T | |
| A | –11 | A | | A | | A | | A | | A | | A | |
| L | 128 | L | | L | | L | | L | | L | | L | |
| ⇩ | | ⇩ | | ⇩ | | ⇩ | | ⇩ | | ⇩ | | ⇩ | |
| T | | 19 | | 20 | 80 | 21 | 63 | 13 | 39 | 14 | 42 | 15 | |
| O | | T | | T | | T | | T | | T | 42 | T | |
| T | | O | | O | | O | | O | | O | | O | |
| A | | T | | T | | T | | T | | T | | T | |
| L | | A | | A | | A | | A | | A | | A | |
| | | L | | L | | L | | L | | L | | L | |
| ⇩ | | ⇩ | | ⇩ | | ⇩ | | ⇩ | | ⇩ | | ⇩ | |
| ⇨ | 128 | 80 | | 148 | | ⇨ | 117 | 59 | | 117 | | 36 | |
| G | SCORE 16–19 | | | | | ⇨ | 80 | SAVE GAME GRAND TOTAL | | | | 117 | |
| A | SCORE 17–20 | | | | | ⇨ | 148 | | | | | 59 | |
| M | BONUS SCORE 22 | | | | | ⇨ | 128 | | | | | 212 | |
| E | TOTAL UP SCORE | | | | | ⇨ | 473 | SUBTRACT | | | | | 22 |
| SUBTRACT SAVE GAME | | | | | | ⇨ | 447 | GIVE TO | | | | | |
| PLAYER #2 GRAND TOTAL | | | | | | ⇨ | 26 | OPPONENT #1 | | | | | |

24 20

FIG–2

METHOD OF PLAYING A CARD GAME

BACKGROUND OF THE INVENTION

The present invention relates generally to games and, more particularly, to a novel card game that can be played by multiple players.

Card games such as poker, hearts, bridge, and rummy are commonly enjoyed by the public. Rummy-type card games are particularly common, and almost everyone knows how to play some variation of a rummy-type game. Rummy-type card games involve players attempting to acquire cards in sequence or cards of the same kind. However, these rummy-type games all involve the same simple strategy.

A need exists for a card game that is familiar to play yet provides the opportunity to formulate strategies different or enhanced from those used in a traditional rummy-type game.

SUMMARY OF THE INVENTION

The present invention provides a method of playing a card game that overcomes at least some of the above-noted problems of the prior art. According to the present invention, a method of playing a card game is provided that includes providing a deck of playing cards, dealing a hand of cards to each player on each team, allowing a player to lay down a set of cards corresponding to a pre-selected group of cards, and ending the round when a player has no cards remaining in his hand. The game is ended when a team has laid down each set of cards from a pre-selected group of cards required to be laid down to end the game.

These and further features and advantages of the invention will become apparent from the following detailed description and drawings.

BRIEF DESCRIPTION OF THE DRAWINGS

FIG. 1 is a score card for a first player in accordance with the preferred embodiment of the present invention.

FIG. 2 is a score card for a second player in accordance with the preferred embodiment of the present invention.

DETAILED DESCRIPTION OF CERTAIN PREFERRED EMBODIMENT(S)

It will be apparent to those skilled in the art, that is, to those who have knowledge or experience in this area, that many variations are possible for the method of playing a card game disclosed herein. The following detailed discussion of various alternative and preferred embodiments will illustrate the general principles of the invention with reference to a method of playing a card game for use with a deck of fifty-two cards numbered 10–22 in groups of four. Other embodiments suitable for other applications will be apparent to those skilled in the art given the benefit of this disclosure. The terms "card" and "cards" are used herein and in the claims to mean either a common card or cards used in a live person game, or to reference a card or cards generated by a computer in a typical computer card game. This definition will apply to all uses of the terms "card" and "cards", including in the terms "hand of cards" and "deck of cards".

With reference to FIGS. 1 and 2, the method of playing a preferred embodiment of the card game of the present invention will now be described. While the embodiments of the present invention described and illustrated herein are particularly adapted for use with a particular score sheet and a deck of fifty-two cards numbered 10–22 in groups of four, it is noted that the present invention can be utilized with numerous other types of score sheets, or no score sheet at all, and any other type of deck having varying numbers of cards. Although the preferred embodiment of the invention is described herein as a game for two people or two teams, it will be appreciated by one skilled in the art that other variations of the invention, such as a game involving other numbers of players or teams, are included in the present invention. It is also noted that although the preferred embodiment of the present invention is described as a live person game without any betting involved, the present invention can be utilized with or without bets being placed in a live person format or a computer-generated game format.

In the preferred embodiment of the present invention, a player begins the game by dealing a hand of cards to each player. As previously mentioned, the preferred deck of cards has fifty-two cards numbered "10" through "22" in groups of four. In the preferred embodiment of the invention, six cards are dealt to each player. Preferably, the dealer then places the deck of cards face down and turns the top card face-up to form a discard pile.

In the preferred embodiment of the invention, a first player begins play by drawing a card from the face-down deck or from the face-up discard pile. The player will then try to "spread", or lay down, certain predetermined sets of cards allowed to be "spread". In the preferred embodiment of the invention, these predetermined sets of cards are sets of three or four cards of the same number. However, the predetermined sets allowed to be laid down will vary depending upon the type of deck used and the level of difficulty desired. Preferably, once a player has laid down all the sets of cards he is allowed to lay down (and all the sets of cards he chooses to lay down in accordance with his strategy), he discards a card into the discard pile so that any cards below the currently discarded card are still visible. In the preferred embodiment of the invention, this is the end of the first player's turn.

Play continues with each player drawing a card, "spreading" predetermined sets of cards ("spreads") allowed and desired to be laid down, and discarding a card. In the preferred embodiment of the invention, additional options of play are available to all players after the first player's first turn. These additional options of play include allowing a player the option of "spreading" a single card out of his hand on an uncompleted "spread" laid down by other players if the single card matches the uncompleted "spread". For example, if player #1 laid down a "spread" of three cards bearing the numeral "11", player #2 could complete the "spread" on his turn by laying an "11" card from his hand onto player #1's "spread". The additional options also include allowing each player the option of drawing multiple cards from the discard pile. In the preferred embodiment of the invention if more than one card is drawn from the discard pile, a player must, in the same turn, play the last card he draws from the discard pile in his own "spread" or another player's "spread".

The round continues with like play until a player has no cards left in his hand (also referred to as "going out"). In the preferred embodiment, each player totals his score for a round when the round is over.

Each player preferably determines his score by adding the predetermined point value for each card that was "spread". In the preferred embodiment, there is a different group of scoring cards for each player or each team. For example, with reference to FIGS. 1 and 2, the score sheets 10 and 12 illustrate that Player #1's scoring cards are the cards bearing the numerals "10", "11", "12", "13", "14", and "15" and Player #2's scoring cards are the cards bearing the numerals "16", "17", "18", "19", "20" and "21". If Player #1 "spreads" three cards bearing the numeral "11" in a particular round, he would enter a total of "33" on his score sheet 10 beside the numeral "11" under the Player #1 Score area 14 of FIG. 1. Bonus cards bearing the numeral "22" are also included in the preferred embodiment. If a player "spreads" any bonus cards during a round, the player enters the total point value of all the Bonus cards "spread" into the Bonus area 16 of the score sheets 10 and 12. In the preferred embodiment, if a player "spreads" any of the other person's scoring cards, he enters the total point value of those cards under the Save Game Area 18 located on the score sheets 10 and 12. In the preferred embodiment, and as further discussed below, each player's Save Game Area total will be used to penalize the other player at the end of the game. This method of scoring is only one way of penalizing a player for cards that another player "spreads", and it will be appreciated by one skilled in the art that other variations of scoring and/or penalizing a player are included in the present invention.

Next, in the preferred embodiment, the player with cards left in his hand at the end of the round totals the point value of the other player's scoring cards and Bonus cards in his hand and subtracts the total from the score in his Bonus area 16. For example, if Player #2 ended the round by having no cards left in his hand, and Player #1 had two "16" cards in his hand, Player #1 would subtract a point total of 32 from the current value of the Bonus area 16 shown to begin at a value of +88 on score sheets 10 and 12. This method of scoring is only one way of penalizing a player for different cards remaining in his hand, and it will be appreciated by one skilled in the art that other variations of scoring and/or penalizing a player for cards remaining in his hand are included in the present invention.

Last, in the preferred embodiment, the player with cards left in his hand at the end of the round totals the point value of his own scoring cards remaining in his hand and gives the total to the other player, who enters it on his Save Game Area 18 of his score sheet 10 or 12. For example, if Player #2 ended the round by having no cards left in his hand, and Player #1 had two "10" cards in his hand, Player #1 would give the point total of 20 to Player #2 to enter in the Save Game Area 18 of his score sheet 12 beside the numeral "10". In the preferred embodiment, as further discussed below, each player's Save Game Area total will be used to penalize the other player at the end of the game. As mentioned above, this method of scoring is only one way of penalizing a player for different cards remaining in his hand, and it will be appreciated by one skilled in the art that other variations of scoring and/or penalizing a player for cards remaining in his hand are included in the present invention.

After the score for each round is recorded, the cards are preferably reshuffled and another round is started by dealing a hand of cards to each player, just as in the first round. Play continues in each additional round, as in the round described above, until the game is ended by a player or a team.

In the preferred embodiment, the game is ended when a player or team has laid down each of a predetermined set of cards required to be laid down to end the game. In the preferred embodiment described herein, the "spreads" required to end the game correspond with each player's or each team's scoring cards. For example, Player #1 would have to "spread" a set of each of the cards bearing the numerals "10", "11", "12", "13", "14", and "15" in order to end the game. In the preferred embodiment, the game ends at the end of the round in which a player has laid down the last one of his "spreads" required to end the game.

After the game is over, the winner is preferably determined by reference to the scores and penalties accumulated by each team or player for each round. In the preferred embodiment, and with reference to FIGS. 1 and 2, the winning player (or team) is determined as follows: (a) totaling the Bonus area 16 and each column under the Player Score area 14 containing a player's score from his scoring cards and combining these totals to determine each player's Total Up Score 20; (b) totaling each column of a player's Save Game Area 18 and combining these totals to determine each player's Save Game Grand Total 22; (c) subtracting, from each player's Total Up Score 20, the other player's Save Game Grand Total 22 to determine each player's Grand Total 24; and (d) comparing each player's Grand Total 24. In the preferred embodiment, the player (or team) with the highest total score will win the game.

With the preferred embodiment of the invention having now been described, including the preferred method of play and preferred method of scoring, other features of the invention become apparent. Most apparent are the varying strategies involved in the preferred embodiment of the invention. For example, each player will be able to calculate the current score between himself (or his team) and other players (or teams) at the end of each round. With this in mind, each player will formulate his own strategy as to what "spreads" he will lay down, what single cards he will draw or discard, and so forth. A player may wish to keep another player or team from obtaining a certain card (or cards) to prevent the other player or team from "spreading" card that will add to their score or that will end the game. Also, if a particular player or team has the ability to end the game, but is below another player or team in scoring, the particular player or team may choose not to play a particular "spread". Many other strategies arise due to the features of the present invention that will be apparent to those skilled in the given the benefit of this disclosure.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the invention discussed herein in connection with a deck of fifty-two cards numbered 10–22 in groups of four could be used in connection with any other type of deck. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A method of playing a card game comprising:

providing a deck of cards;

beginning a round by dealing a hand of cards to each player on each team, each team comprising one or more players;

allowing each player in turn to lay down a set of cards corresponding to a pre-selected group of cards;

ending the round when a player has no cards remaining in his hand;

beginning additional rounds until the game ends;

identifying, for each team, a pre-selected group of cards required to be laid down to end the game, wherein the pre-selected group of cards required to be laid down to end the game is different for each team; and ending the game when a team has laid down, during the rounds, a set of each card in the pre-selected group of cards required to be laid down to end the game for that team.

2. The method of claim 1 wherein the deck of cards includes cards not belonging to any pre-selected group of cards required to be laid down to end the game.

3. The method of claim 1 further comprising:

determining a team's score after each round by adding a predetermined point value for each card laid down by each player on that team.

4. The method of claim 3 wherein the step of determining a team's score after each round further comprises subtracting a pre-selected point value from a team's score for each card from a pre-selected group remaining in each player's hand on that team.

5. The method of claim 1 further comprising:

determining a team's score after each round by adding a predetermined point value for each card laid down by each player on that team that corresponds to the pre-selected group of cards required to be laid down to end the game.

6. The method of claim 1 wherein the step of determining a team's score after each round further comprises subtracting a pre-determined point value for each card remaining in each player's hand on that team that is from the pre-selected group of cards required to be laid down to end the game for another team.

7. The method of claim 1 wherein the step of determining a team's score after each round further comprises subtracting a pre-determined point value for each card from the pre-selected group of cards required to be laid down to end the game for that team that is laid down by a player on another team.

8. The method of claim 1 further comprising:

determining the winning team by:

granting a pre-selected point value to each team's score for each set of cards laid down by each player on that team during each round;

subtracting a pre-selected point value from each team's score for cards from a pre-selected group remaining in each player's hand on that team at the end of each round;

subtracting a pre-selected point value from each team's score for cards from a pre-selected group laid down by each player on another team during each round; and determining the team with the highest total score.

9. The method of claim 1 wherein each card in the pre-selected group of cards required to be laid down to end the game by a first team is different from each card in the pre-selected group of cards required to be laid down to end the game by a second team.

10. The method of claim 1 wherein the deck of cards includes four each of thirteen different types of cards for a total of 52 cards, the pre-selected group of cards required to be laid down to end the game by a first team includes six of the thirteen different types of cards, and the pre-selected group of cards required to be laid down to end the game by a second team includes six of the thirteen different types of cards.

11. The method of claim 10 wherein the six different types of cards required to be laid down to end the game by the first team are each different than the six different types of cards required to be laid down to end the game by the second team.

12. The method of claim 1 wherein the deck of cards includes four each of thirteen different types of cards for a total of 52 cards.

13. A method of playing a card game comprising:

providing a deck of cards;

dealing a hand of cards to each player on each team, each team comprising one or more players;

allowing a player to lay down a set of cards corresponding to a pre-selected group of cards;

ending the round when a player has no cards remaining in his hand; and ending the game when a team has laid down each set of cards from a pre-selected group of cards required to be laid down to end the game, wherein the pre-selected group of cards required to be laid down to end the game is different for each team.

14. The method of claim 13 further comprising:

determining a team's score after each round by adding a predetermined point value for each card laid down by each player on that team if the card is from the pre-selected group of cards required to be laid down by that team to end the game.

15. The method of claim 14 wherein the step of determining a team's score after each round further comprises subtracting a predetermined point value for each card left in each player's hand on that team if the card is from the pre-selected group of cards required to be laid down by any other team to end the game.

16. The method of claim 14 wherein the step of determining a team's score after each round further comprises subtracting a pre-determined point value for each card from the pre-selected group of cards required to be laid down by that team to end the game that is laid down by a player on another team.

17. A method of playing a card game comprising:

providing a deck of playing cards;

dealing a hand of cards to each player on each team, each team comprising one or more players;

allowing a player to draw a card from a face-up discard pile or from a face-down set of cards, lay down a predetermined set of cards, and discard a card from the player's hand;

ending the round when a player has no cards remaining in his hand;

ending the game when a team has laid down each set of cards from a pre-selected group of cards required to be laid down to end the game, said pre-selected group of cards required to be laid down to end the game being different for each team; and determining the winning team by:

(a) separately totaling, for each team, scores from each round, wherein the scores from each round are determined by adding a predetermined point value for each card laid down by each player on a team after each round that is from the pre-selected group of cards required to be laid down by that team to end the game and subtracting a predetermined point value for each card left in each player's hand on that team that is from the pre-selected group of cards required to be laid down by any other team to end the game;

(b) separately totaling, for each team, the predetermined point value of each card that was left in each player's hand on a team after every round if the card is from the pre-selected group of cards required to be laid down by that team to end the game;

(c) separately totaling, for each team, the predetermined point value for each card that is from the pre-selected group of cards required to be laid down by that team to end the game that is laid down by a player on another team during each round;

(d) separately subtracting, for each team, the totals determined in (b) and (c) from the total determined in (a) to determine each team's final score; and (e) comparing each team's final score.

* * * * *